US005647495A

United States Patent [19]

Orimoto et al.

[11] Patent Number: 5,647,495

[45] Date of Patent: Jul. 15, 1997

[54] HEAT-RESISTANT CONSTRUCTION OF A NECK OF A SYNTHETIC RESIN CONTAINER

[75] Inventors: Hiroyuki Orimoto; Yoji Okuda, both of Nagano-ken, Japan

[73] Assignee: Nissei ASB Machine Co., Ltd., Japan

[21] Appl. No.: 750,930

[22] Filed: Aug. 28, 1991

Related U.S. Application Data

[63] Continuation of Ser. No. 526,676, May 21, 1990, abandoned, which is a continuation of Ser. No. 269,144, Oct. 26, 1988, abandoned.

[30] Foreign Application Priority Data

| | | | |
|---|---|---|---|
| Feb. 27, 1987 | [JP] | Japan | 62-45434 |
| Sep. 30, 1987 | [JP] | Japan | 62-247475 |
| Feb. 26, 1988 | [WO] | WIPO | 88/00215 |

[51] Int. Cl.[6] ..... B65D 1/42; B65D 23/02; B65D 23/08; B29C 45/16

[52] U.S. Cl. ..... 215/42; 215/40; 215/44; 264/513

[58] Field of Search ..... 215/1 C, 12.2, 215/31, 40, 42, 44; 264/521, 513, 516, 523

[56] References Cited

U.S. PATENT DOCUMENTS

| | | | |
|---|---|---|---|
| 4,079,850 | 3/1978 | Suzuki et al. | 215/1 C |
| 4,174,413 | 11/1979 | Yasuike et al. | 215/1 C X |
| 4,327,137 | 4/1982 | Sawa et al. | 428/36.6 |
| 4,341,317 | 7/1982 | Suzuki et al. | 215/31 |
| 4,482,586 | 11/1984 | Smith et al. | 215/12.2 |
| 4,501,781 | 2/1985 | Kushida et al. | 215/12.2 |
| 4,535,901 | 8/1985 | Okudaira et al. | 215/1 C |
| 4,550,043 | 10/1985 | Beck | 215/1 C X |
| 4,591,060 | 5/1986 | Tsukada et al. | 215/31 X |
| 4,610,366 | 9/1986 | Estes et al. | 215/31 X |
| 4,646,925 | 3/1987 | Nohara | 215/12.2 X |
| 4,715,504 | 12/1987 | Chang et al. | 215/1 C |
| 4,781,954 | 11/1988 | Krishnakumar et al. | 215/1 C X |

FOREIGN PATENT DOCUMENTS

| | | | |
|---|---|---|---|
| 144450 | 6/1985 | European Pat. Off. | 215/1 C |
| 161625 | 11/1985 | European Pat. Off. . | |
| 54-72180 | 6/1979 | Japan | 215/31 |
| 55-89056 | 7/1980 | Japan | 215/31 |
| 58-42535 | 6/1983 | Japan | 264/521 |
| 61-5707 | 1/1986 | Japan | 215/31 |
| 61-5708 | 1/1986 | Japan | 215/31 |
| 61-259946 | 11/1986 | Japan | 215/31 |
| 62-99506 | 6/1987 | Japan | 215/31 |
| 63-55 | 1/1988 | Japan . | |
| 63-07054 | 12/1988 | Japan | 215/31 |
| 63-194115 | 12/1988 | Japan | 215/31 |
| 992750 | 5/1965 | United Kingdom | 215/31 |

*Primary Examiner*—Sue A. Weaver

*Attorney, Agent, or Firm*—Ostrolenk, Faber, Gerb & Soffen, LLP

[57] ABSTRACT

A container, which may be injection molded in a single mold, includes a main body and a hollow cylindrical neck. The neck extends along a main axis and has a proximate end connected to the main body and an open distal end. The neck includes a generally cylindrical inner layer formed of a first thermoplastic material, a generally cylindrical middle layer located radially outward of the inner layer and formed of a second thermoplastic material having a greater heat resistance than the first thermoplastic material, and a generally cylindrical outer layer located radially outward of the middle layer so that the middle layer is at least partially sandwiched between the inner and outer layers. The outer layer is formed of the first thermoplastic material. An open end section extends from and is integral with the middle layer, is formed with the second thermoplastic material, and extends radially along the entire radial extent of the open distal end of the neck so that the entire open distal end of the neck is formed by the open end section.

17 Claims, 2 Drawing Sheets

HEAT-RESISTANT CONSTRUCTION OF A NECK OF A SYNTHETIC RESIN CONTAINER

RELATED APPLICATIONS

This is a continuation of application Ser. No. 07/526,676 filed May 21, 1990, now abandoned, which is a continuation of application Ser. No. 07/269,144 filed Oct. 26, 1988, now abandoned.

FIELD OF ART

This invention relates to a heat resistant construction for a neck of a synthetic resin container used as a packaging container for liquids such as juice, food oil, seasoning or the like, which containers are required to be heated and filled.

BACKGROUND OF THE ART

In thin-wall synthetic resin containers whose body portion and bottom portion are bi-axially oriented by orientation blow molding, the neck portion of the container which is formed by preform injection or extrusion molding is in a non-oriented state and exhibits poor heat resistance characteristics. Therefore, in containers such as bottles formed of polyethylene terephthalate resin, the neck portion is often deformed after the container is heated.

In view of the foregoing, as shown in FIGS. 5 and 6, there has been contemplated a neck portion 20 having a three-layer construction which is resistant to heat. The neck portion 20 includes a heat resistant layer 21, formed of a thermoplastic resin excellent in heat resistance, which is surrounded by an inner layer 22 and an outer layer 23 formed of a neck-forming resin.

In the above-described conventional construction, the heat resistant layer 21 prevents the peripheral portion of the neck portion 20 from being deformed as a result of the application of heat. However, the open end 24 of the neck portion is still subject to heat deformation. More particularly, the outer peripheral edge 25 of the outer layer 23 produces a partial strain due to the heat deformation of the open end 24, thus posing the problem that the contents of the container leak after a cap has been sealed.

DISCLOSURE OF THE INVENTION

The present invention solves the problem encountered in the neck portion having the three-layer construction as described above. It is an object of this invention to provide a neck portion having a heat resistant construction in which heat deformation of an open end can be prevented by utilizing a heat resistant layer formed within the neck portion to further enhance the heat resistance of the neck portion.

It is a further object of this invention to provide a neck portion having a heat resistant construction in which an external portion to the neck portion includes an open end and a support ring formed of heat resistant resins, whereby the heat deformation of both the neck portion and the open end is unlikely to occur, and a container can sufficiently withstand external forces applied thereto as a result of the integral structure of the neck forming resin and the heat resistant resin.

For achieving the aforementioned objects, this invention provides a construction of a neck portion having a multi-layer construction in which a thermoplastic resin forming the neck portion of the container is interiorly provided with a heat resistant layer formed of a thermoplastic resin excellent in heat resistance relative to the neck forming resin, wherein a part of the resin forming the heat resistant layer is exposed outside the neck forming resin at an open end of the neck portion, the open end or the open end and a portion outside the neck portion are formed of the same heat resistant resin as the heat resistant layer, and the heat resistant layer extends into a support ring to provide a heat resistance.

BEST MODE FOR CARRYING OUT THE INVENTION

Figure 1:
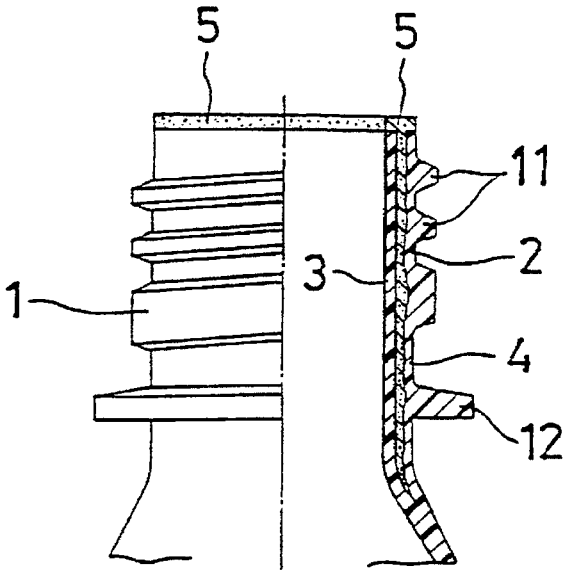
FIG. 1 is a half longitudinal sectional view showing a heat resistant resin container according to a first embodiment of this invention.
Figure 2:
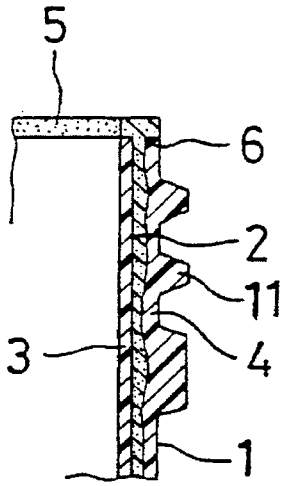
FIG. 2 is a longitudinal sectional view partly in an enlarged scale of the embodiment of FIG. 1.

In. FIGS. 1 and 2, reference numeral 1 designates a neck integrally formed with a thread portion 11 and a support ring 12 in the outer periphery thereof. The neck is formed of three layers including inner and outer layers 3 and 4, each formed of a neck forming material such as polyethylene terephthalate, and a middle heat resistant layer 2 formed of a heat resistant resin selected from the group consisting of a polycarbonate, a polyamide, an ethylene vinyl alcohol copolymer, and an alloy of polyamide or carbonate and polyethylene terephthalate.

An open end portion 5 of the neck 1 is formed by extending the heat resistant layer 2 to a position outside (i.e., no longer in between) the inner and outer layers 3,4 formed so that the ends of the inner layer 3 and outer layer 4 are coated with the heat resistant resin forming the open end portion 5.

The thickness of the open end portion 5 can be suitably adjusted when the neck 1 is injection molded. Since the open end portion 5 is molded integrally with the heat resistant layer 2, any external forces applied to the open end portion 5 are transmitted through the whole neck via the heat resistant layer 2, rather than being concentrated at the joined surface 6 (FIG. 2) located between the open end portion 5 and the inner and outer layers 3,4. As a result, even when the open end portion 5 is formed as a thin layer, no peeling or damage due to the application of external forces will occur.

The open end portion 5 can be molded by simultaneously injecting the neck forming resin and a heat resistant layer forming resin to form the three layered neck 1 in a single operation.

In carrying out this method, it is preferable to use a triple nozzle having an inner layer forming nozzle, a heat resistant layer forming nozzle and an outer layer forming nozzle superposed in a concentric fashion. In the case where only the neck 1 is formed in a multi-layer construction, a check valve may be provided on the heat resistant layer forming nozzle to control the injection of the heat resistant forming resin.

Figure 6:
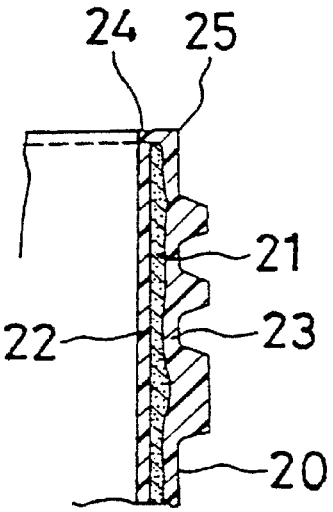
FIG.6 PRIOR ART
FIG. 6 is a longitudinal sectional view partly in an enlarged scale of prior art.

In molding, a required quantity of the neck forming resins is injected into a cavity simultaneously from two nozzles for forming the inner and outer layers to form the body of the container. Next, the heat resistant layer forming resins, as well as the neck forming resins, are simultaneously injected from the nozzle to form the neck 1. In this case, if the first quantity of injection is too large, even if the heat resistant layer forming resins reach the neck opening of the mold, the heat resistant layer forming resins do not extend to a position outside of the layers 3,4 and the open end portion 5 is not formed. Rather, the neck forming resins fully surround the heat resistant resins as in the conventional construction shown in FIG. 6.

Figure 3:
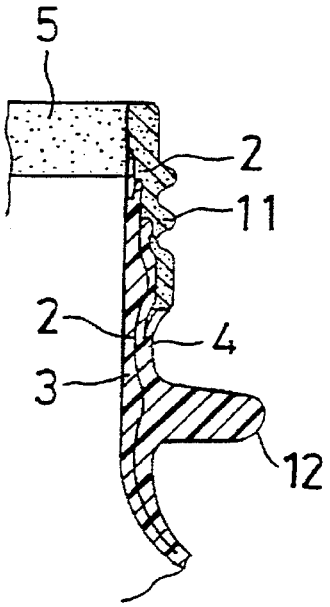
FIG. 3 is a longitudinal sectional view in an enlarged scale showing essential parts of a second embodiment of the present invention.
Figure 4:
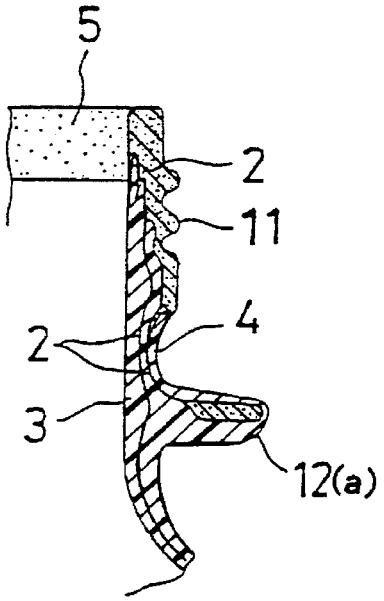
FIG. 4 is a longitudinal sectional view in an enlarged scale, showing essential parts of a third embodiment of the present invention.
Figure 5:
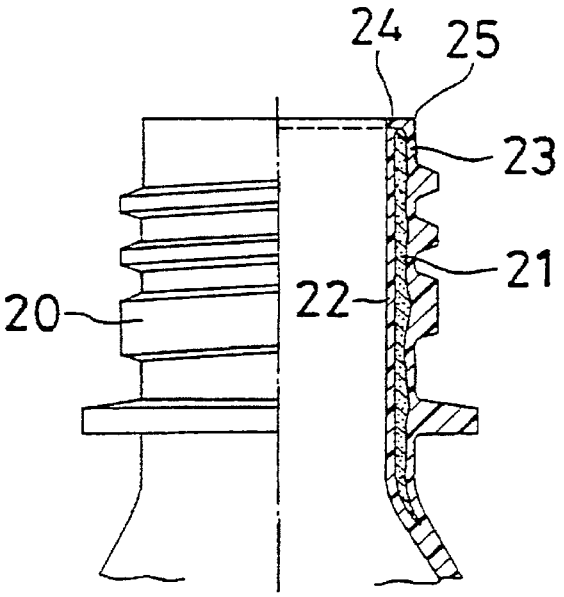
FIG.5 PRIOR ART
FIG. 5 is a longitudinal sectional view of a construction of a neck portion of a prior art container.

A second embodiment of the invention is shown in FIG. 3. In this embodiment, a neck 1 is formed of heat resistant resins with an open end portion 5 and a thread portion 11 outside the neck exposed externally from the interior of the neck forming resins. FIG. 4 shows a third embodiment wherein a neck includes a heat resistant layer which extends from the thread portion 11 into the support ring 12*a* to provide heat resistance from the support ring 12*a* to the open end 5.

Such a construction of the neck can be easily obtained by adjusting a quantity of the neck forming resins first injected, the injection speed, the injection pressure, the injection timing, and the like, so that the heat resistant layer-forming resins within the neck forming resins are exposed from the open end 5 to a portion near the thread portion 11.

In the construction of a neck according to this invention, the heat resistant layer is formed in between the heat resistant resins, and the heat resistant layer-forming resins are exposed to or extended to the open end portion of the neck of the container or the outer portions of the open end portion and the neck and, in addition, the thread portion and the interior of the support ring. Therefore, not only the peripheral wall portion of the neck portion but the open end portion are heat resistant and, even if it is put into a bath at 85° C. for 10 minutes, no heat deformation occurs in the open end portion or the upper portion of the support ring. In addition, the heat resistant layer and the open end portion (and in the second and third embodiments, the outer portion of the neck) are integrally formed and, therefore, the neck can sufficiently withstand external forces, and even if the open end portion, the thread portion and the like are molded of resins different from the neck forming resin, they will not peel off when the cap is sealed.

In this invention, the outer portion of the neck, including the open end of the neck and the open end and, in addition, the support ring, are formed of resins having the heat resistance as described above and, therefore, the heat resistance is enhanced as compared with the case where only an interior heat resistant layer is formed. Additionally, the article can withstand external forces applied to the neck as a result of the integral structure of the neck forming resin and the heat resistant resin. Therefore, this invention can be used as a heat resistant construction of a neck of a packaging container for liquids wherein the container requires heating and filling, and molding can be easily carried out by applying a conventional multi-layer injection molding process, which is therefore very effective in industry and can be used extensively.

We claim:

1. A container comprising a main body and a hollow cylindrical neck, the neck extending along a main axis and having a proximate end coupled to the main body and an open distal end, the neck including:

(a) a generally cylindrical inner layer formed of a first thermoplastic material;

(b) a general cylindrical middle layer located radially outward of the inner layer and formed of a second thermoplastic material having a greater heat resistance than the first thermoplastic material;

(c) a generally cylindrical outer layer located radially outward of the middle layer so that the middle layer is at least partially sandwiched between the inner and outer layers, the outer layer being formed of the first thermoplastic material; and (d) an open end section which extends from and is integral with the middle layer, is formed of the second thermoplastic material, and extends radially along the entire radial extent of the open distal end of the neck so that the entire open distal end of the neck is formed by the open end section.

2. The container of claim 1, wherein the cylindrical neck has external threads formed therein.

3. The container of claim 2, wherein the external threads are formed in the outer layer of the neck only.

4. The container of claim 3, wherein the neck has an annular support ring formed therein at a location between the threads and the proximate end of the neck.

5. The container of claim 4, wherein the annular support ring is formed in the outer layer of the neck.

6. The container of claim 2, wherein the open end section extends axially along the outside of the outer layer of the neck and the external threads are formed in the axially extending portion of the open end section.

7. The container of claim 1, wherein the first thermoplastic material comprises a polyethylene terephthalate and the second thermoplastic material is selected from the group consisting of a poly carbonate, a polyamide, an ethylene vinyl alcohol copolymer, an alloy of polyamide and polyethylene terephthalate and an alloy of poly carbonate and polyethylene terephthalate.

8. The container of claim 1, wherein the inner, middle and outer layers of the neck are formed simultaneously.

9. The container of claim 8, wherein the body and the inner, middle and outer layers of the neck are injection molded in a single mold.

10. The container of claim 9, wherein the main body and the neck are formed integrally with one another in a single molding operation.

11. A method of forming a container of the type which includes a main body and a hollow cylindrical neck, the neck extending along a main axis and having a proximate end coupled to the main body and an open distal end, the process comprising the steps of:

(a) injection molding the main body and the cylindrical neck in a single mold and forming the neck by simultaneously injecting into the mold:

(1) a generally cylindrical inner layer formed of a first thermoplastic material;

(2) a generally cylindrical middle layer located radially outward of the inner layer and formed of a second thermoplastic material having a greater heat resistance than the first thermoplastic material;

(3) a generally cylindrical outer layer located radially outward of the middle layer so that the middle layer is at least partially sandwiched between the inner and outer layers, the outer layer being formed of a first thermoplastic material; and (b) injecting an open end section into the mold, the open end section extending from and being integral with the middle layer, being formed of the second thermoplastic material, and extending radially along the entire radial extent of the distal end of the neck so that the entire distal end of the neck is formed by the open end section.

12. The method of claim 11, wherein the cylindrical neck has external threads formed therein.

13. The method of claim 12, wherein the external threads are formed in the outer layer of the neck only.

14. The method of claim 13, wherein the neck has an annular support ring formed therein at a location between the threads and the proximate end of the neck.

15. The method of claim 14, wherein the annular support ring is formed in the outer layer of the neck.

16. The method of claim 12, wherein the open end section extends axially along the outside of the outer layer of the neck and the external threads are formed in the axially extending portion of the open end section.

17. The method of claim 11, wherein the first thermoplastic material comprises a polyethylene terephthalate and the second thermoplastic material comprises a poly carbonate, a polyamide, an ethylene vinyl alcohol copolymer and an alloy of polyamide or poly carbonate and polyethylene terephthalate.

* * * * *